US007134161B2

(12) United States Patent
Campos

(10) Patent No.: US 7,134,161 B2
(45) Date of Patent: Nov. 14, 2006

(54) MECHANICAL BROOM

(76) Inventor: Telmo Olavo Campos, R.D. Caludio J.G. Ponce de Leon, 446-Porto Alegro-RS (BR)

( * ) Notice: Subject to any disclaimer, the term of this patent is extended or adjusted under 35 U.S.C. 154(b) by 0 days.

(21) Appl. No.: 10/751,582

(22) Filed: Jan. 5, 2004

(65) Prior Publication Data

US 2005/0144746 A1 Jul. 7, 2005

(51) Int. Cl.
*A47L 11/32* (2006.01)
*A47L 11/33* (2006.01)

(52) U.S. Cl. ..... 15/48.1; 15/46; 15/41.1; 74/810.1

(58) Field of Classification Search ..... 15/40, 15/41.1, 42, 46, 48.1, 44, 45; 192/43, 46; 74/810.1, 126
See application file for complete search history.

(56) References Cited

U.S. PATENT DOCUMENTS 642,172 A 1/1900 Sweitzer
643,634 A 2/1900 Dodd
756,358 A * 4/1904 Hardy ..... 15/48.1
879,977 A 2/1908 Morrison et al.
1,972,870 A * 9/1934 Christesen ..... 15/41.1
2,563,189 A 8/1951 Rigby
2,587,038 A * 2/1952 Goodell ..... 15/48
2,625,698 A * 1/1953 De Kadt Maurits et al. .... 15/45
2,783,487 A * 3/1957 Luders ..... 15/41.1
3,602,932 A * 9/1971 Morris et al. ..... 15/48.1
3,638,267 A * 2/1972 Liebscher ..... 15/41.1
4,007,508 A * 2/1977 Ooyachi ..... 15/42
4,823,422 A * 4/1989 Yoshimura et al. ..... 15/41.1
5,239,721 A * 8/1993 Zahuranec ..... 15/41.1

* cited by examiner

*Primary Examiner*—Gary K. Graham
(74) *Attorney, Agent, or Firm*—Stephen E. Feldman P.C.

(57) ABSTRACT

A sweeper comprising a main wheel being capable of spinning in both a counterclockwise and a clockwise direction in response to the broom being moved backwards or forwards. The sweeper has a brush wheel driven by the main wheel and being capable of spinning in one direction irrespective of the spinning direction of the drive wheel. The sweeper has a plurality of intermediate wheels capable of translating the spinning motion from the drive wheel to the brush wheel, and each of the wheels being capable of simultaneous and non-slip spinning.

14 Claims, 4 Drawing Sheets

MECHANICAL BROOM

FIELD

The invention relates to floor sweepers and more specifically to mechanical floor sweepers.

BACKGROUND

Carpet sweepers are known in the art, and one common style of sweeper is a bi-directional carpet sweeper. The sweeper has a brush wheel, a main drive wheel and a housing. To clean a carpet, the housing is moved in either a forward or reverse direction, depending on whether the sweeper is being pushed or pulled. The main drive wheel rotates in the direction of the housing and the brush wheel rotates in a single direction regardless of the direction of the main drive wheel or housing. Accordingly, the sweeper is capable of removing dirt from a carpet regardless of whether the sweeper is being pushed or pulled. The following discloses several of these carpet sweepers and the problems associated with these sweepers.

U.S. Pat. No. 642,172 to Sweitzer discloses a bi-directional sweeper. The brush wheel is controlled by a series of gears connected to a broom handle. The motion of the broom handle affects the configuration of the gears enabling the bi-directional motion.

One problem with Sweitzer is that the handle must be moved to change the configuration of the gears. Accordingly, the handle cannot be removed from the broom and the broom is prohibited from being used as a hand held device.

U.S. Pat. No. 643,634 to Dodd discloses a bi-directional sweeper. The sweeper has a pitman arm that has a first and second ends. The first end is connected to the drive wheel and the second end is capable of controlling the brush wheel. The second end has a set of gear teeth that intersect the spinning axis of the brush wheel. The brush wheel has a pair of pinion wheels that are mounted along the axis of the brush wheel and flank the gear teeth of the pitman arm. Each pinion wheel has a pawl which engages the pinion wheel and allows that pinion wheel to spin in one direction. The resulting rotation of both pinion wheels facilitates spinning of the brush wheel in the same direction, regardless of whether the drive wheel is spinning in the forward or reverse direction.

The problem with Dodd is that both pinion wheels and both pawls must be in line with the brush wheel for the mechanism to operate. The pinion wheels and pawls must be exceedingly thin so as not to diminish the surface area of the brush wheel. The required location of the pinions and pawls makes these components readily susceptible to receiving the infiltration of dirt. The required-size of the pinions and pawls makes these components susceptible to clogging by the infiltrated dirt.

U.S. Pat. No. 879,977 to Morrison, et al. discloses a bi-directional sweeper. The sweeper has a first and second set of drive components located on opposing sides of the housing. Each set of components consists of a drive wheel, a combination of a boss wheel and a pawl, and a set of gears. Each respective boss wheel is adjacent to, and in contact with, the each respective drive wheel. Each respective set of gears is in contact with the respective boss wheel and the brush wheel. The first and second set of components are on opposing ends of the housing for placing the gears outboard of the brush wheel. The sets of components are required to be narrow for maximizing the surface area of the brush wheel.

In Morrison, the when the sweeper is pushed, the first pawl presses against the first boss to activate the first set of drive components. When the sweeper is pulled, the second pawl presses against the second boss to activate the second set of drive components. As a result, the brush wheel spins in the same direction regardless of whether the sweeper is pushed or pulled.

Morrison has a problem in that the sweeper requires two full sets of drive components, where the sets are narrow to maximize the surface area of the brush wheel. The function of each set of components is dependent on a single narrow pawl on that set. Each narrow pawl must absorb the entire stress of operating the sweeper in a single direction. Accordingly, each pawl will suffer fatigue within a relatively short period of time.

U.S. Pat. No. 2,563,189 to Rigby discloses a bi-directional sweeper. The sweeper has two brush wheels, each wheel being capable of rotating in a single direction. Each brush wheel is connected to a respective combination of a boss and a pawl, and each respective boss is engaged upon the selective pivoting of the handle of the sweeper. The challenge with Rigby is that the handle cannot be removed from the broom so that the broom is incapable of being used as a hand held device.

U.S. Pat. No. 3,602,932 to Morris, et al. discloses a bi-directional sweeper. The sweeper has a first and a second brush wheel. The first wheel rotates in the opposite direction from the second wheel and the first wheel rotates when the second wheel is stationary. One problem with Morris is that there are two brushes that require constant cleaning.

SUMMARY

A sweeper is disclosed, the sweeper comprising a drive wheel being capable of spinning in both a counterclockwise and a clockwise direction. The sweeper has a brush wheel driven by the drive wheel and being capable of spinning in one direction irrespective of the spinning direction of the drive wheel. The sweeper has a plurality of intermediate wheels capable of translating the spinning motion from the drive wheel to the brush wheel, and each of the wheels being capable of simultaneous and non-slip spinning.

BRIEF DESCRIPTION OF THE FIGURES

In order that the manner in which the above recited objectives are realized, a particular description of the invention will be rendered by reference to specific embodiments thereof that are illustrated in the appended drawings. Understanding that the drawings depict only typical embodiments of the invention and are not therefore to be considered to be limiting of its scope, the invention will be described and explained with additional specificity and detail through the use of the accompanying drawings in which.

DESCRIPTION OF THE EMBODIMENTS

Figure 1:
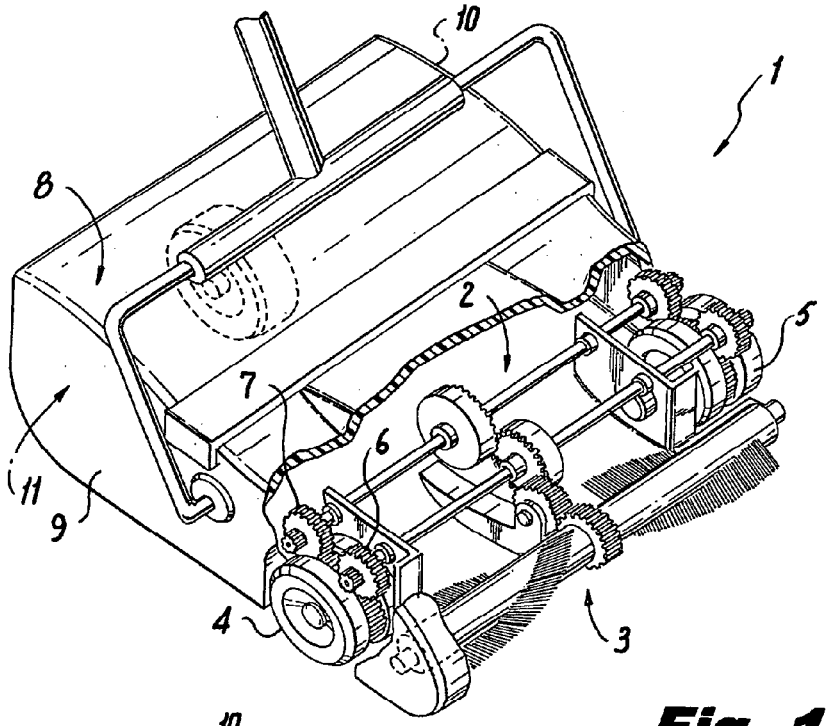
FIGS. 1–5 are a perspective view of the sweeper, with the internal gears exposed.

Turning to FIG. 1, a sweeper 1 is disclosed having a drive system 2 that causes a brush wheel 3 to rotate in a single direction regardless of the motion of the sweeper 1, where the drive system comprises wheels that capable of continuous and non-slip spinning.

The drive system 2 of the sweeper 1 has proximal and distal main wheels 4 and 5 that are capable of spinning in both a clockwise and counterclockwise direction. The drive system 2 has front and rear drive wheels 6 and 7 that are capable of being spun by the main drive wheels 4 and 5 and are capable of spinning the brush wheel 3. The drive wheels 6 and 7 rotate independently forward and backward, driven by the movement of the case and the contact with the floor.

The sweeper also has a case 8, where the case 8 has parallel side walls 9 and 10 for mounting the drive system 2 and brush wheel 3. The case 8 has a rear dust pan 11 for storing the debris consumed by the drive system 2.

Figure 2:
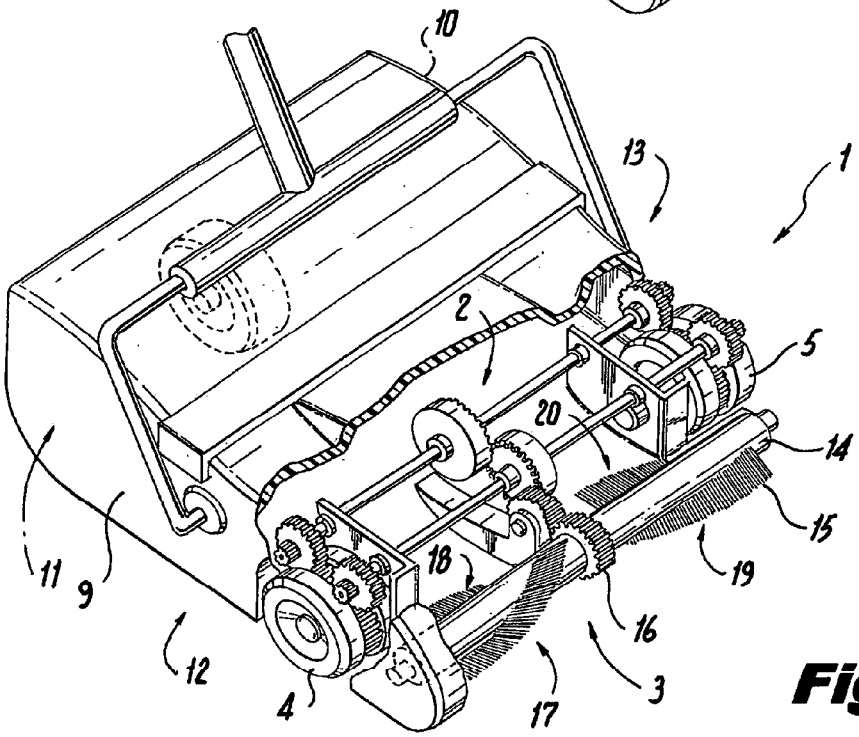

Turning now to FIG. 2, the drive system 2 and brush 3 are illustrated. The sweeper brush 3 has a length that allows for efficient cleaning a carpet or floor. For example, the brush wheel 3 is between one foot and two feet long. Preferably, the sweeper brush 3 is eighteen inches long.

The brush wheel 3 has a proximal end 12 and a distal end 13. Each end 12 and 13 is connected to the respective case wall 9 and 10 so that the brush 3 is capable of substantially friction free rotation. For example, the brush 3 is connected to the case with oil free bearings.

The brush wheel 3 has a brush bar 14. The bar 14 is fabricated from a material that is capable of withstanding normal use. For example, the bar 14 is fabricated form a rigid plastic.

The brush 3 has bristles 15. The bristles are integrally connected to the brush 3. The bristles 15 are fabricated from a material suitable for cleaning household surfaces and floors. For example, the bristles 15 are fabricated from a synthetic plastic.

The brush bar 14 has a diameter and bristles 15 have a length that, in combination, creates an effective agent for removing dirt and dust from surfaces. For example, the brush bar 14 has a diameter that is between half and inch and two inches, and preferably an inch and a quarter. The bristles 15 have a length that is between three and five times the diameter of the brush bar 14, and preferably three times the diameter of the brush bar 14.

The brush 3 has a center gear 16. The center gear 16 receives rotational energy from the drive system 2 and drives the brush bar 14. The center gear is integral to the remainder of the brush bar 14 and fabricated from the same material as the bar 14.

The center gear 16 has a thickness which defines a surface area that is sufficient to drive the brush wheel 3 during normal use. The outer diameter of the gear 16 is substantially the same as the diameter for the brush bar 14. Equalizing the diameter of the brush gear 16 to that of the brush bar 14 decreases the shear stress between the components of the brush wheel 3.

On the proximal segment of the brush gear 16, the bristles 0.15 define a forward and rearward bristle arrays 17 and 18. The bristle arrays 17 and 18 are located on the forward and rearward quadrants of the brush bar 14, respectively. Each bristle on array 17 and has a matching bristle on array 18, separated by 180 degrees. Separating the bristles by 180 degrees allows for twice as much cleaning per rotation of the brush 3. Each strand on array 17 is placed rearward on the circumference of the brush bar 14, relative to the immediately distal strand. This augmentation assists in sweeping the dirt or debris into the dust canister 11 within the sweeper 1.

On the distal side of the gear 16 are another forward and rearward bristle arrays 19 and 20. The forward and rearward arrays 19 and 20 are placed similarly that of the proximal arrays 17 and 18. Situating bristles on both sides of the gear 16 diminishes rotational shear forces that would exist if bristles existed on a single side of the gear 16.

On the proximal side of the brush 3, Bristle array 17 is protrudes perpendicularly to bristle array 19 and with a reverse helix pitch to bristle array 19. The distal side of the brush 3, bristle array 18 protrudes perpendicularly to bristle array 20 and with a reverse helix pitch to bristle array 20. The combination of these structural configurations enables the sweeper to remove dirt from a floor with less contact.

In use, the brush wheel 3 spins clockwise, towards the bottom of the sweeper 1. Spinning clockwise allows the brush 3 to scoop the dirt into the dust pan 11 within the sweeper. The directional rotation of the brush 3 is consistent regardless of whether the sweeper 1 is being pushed or pulled. The consistent spinning motion enables the sweeper 1 to uninterruptedly sweep dirt to be into the dirt chamber within the sweeper 11.

Figure 3:
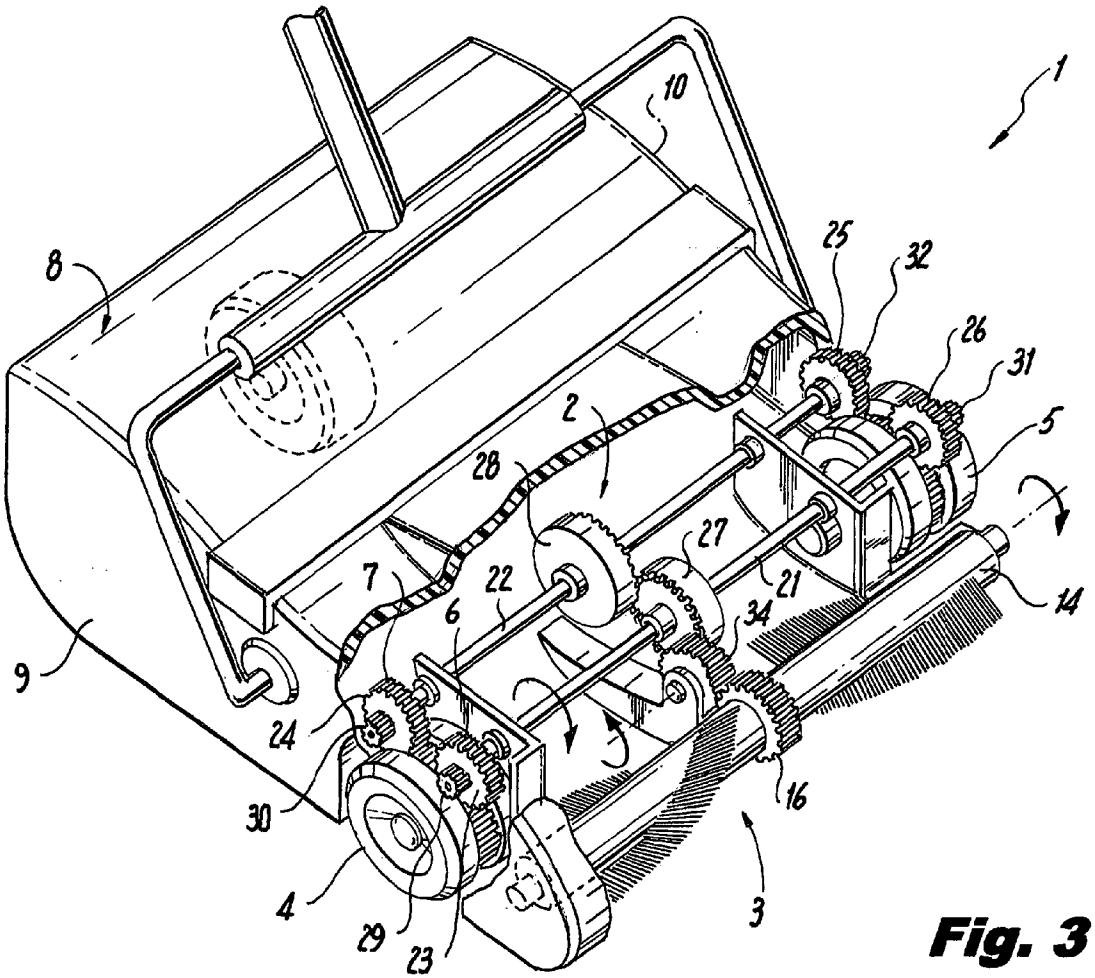
Figure 4:
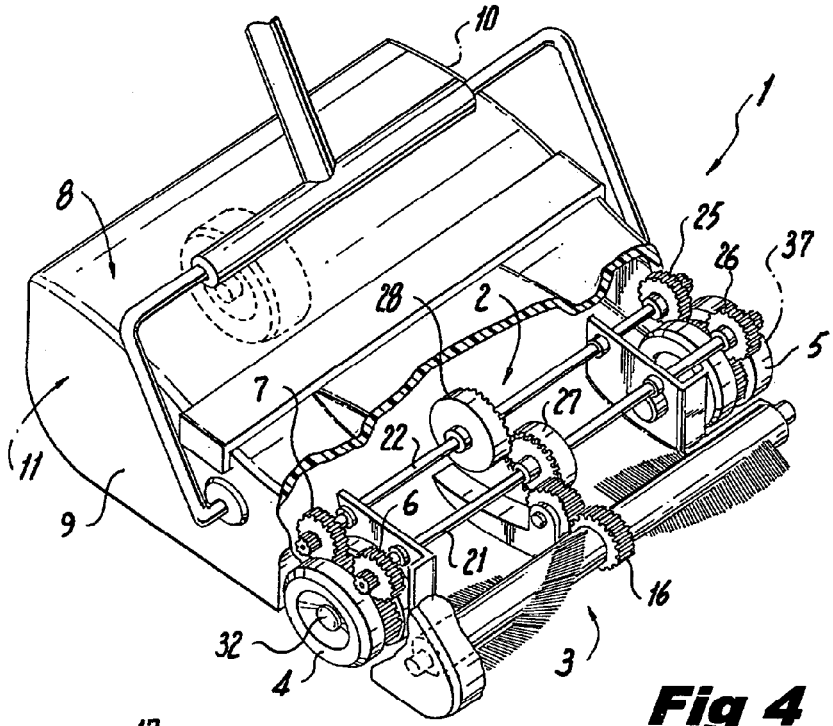

Turning now to FIG. 3, the drive system 2 is illustrated. The front and rear drive wheels 6 and 7 are used to transfer rotational energy through the drive system 2 and to the brush wheel 3. Each wheel 6 and 7 is fabricated entirely from a rigid material that is capable of withstanding the rotational motion applied during normal operation. For example, each wheel 6 and 7 is fabricated from a rigid plastic.

The wheels 6 and 7 are mounted within the case 8 to be both mutually parallel and parallel with the brush wheel 3.

This configuration allows the turning motion in the drive system 2 to be easily transmitted to the brush wheel 3.

Each drive wheel 6 and 7 has a length defined by a respective center bar 21 and 22. The length of each center bar 21 and 22 is substantially the same as the length of the brush bar 14. The length of the drive wheels 21 and 22 enables the mounting of the wheels 21 and 22 on the walls 9 and 10 of the case 8.

Each center bar 21 and 22 has a diameter that is large enough to withstand normal stress and strain due to operational motion. For example, the diameter of each center bar 21 and 22 is substantially one quarter of the diameter of the brush bar 14.

Each drive wheel 6 and 7 has a proximal end 23 and 24 and a distal end 25 and 26. Each distal end 25 and 26 is connected to the distal side of the case 9 and each proximal end 23 and 24 is connected to the proximal side of the case 10. Each wheel 6 and 7 is connected at the case 8 for a friction-free rotation with, for example, oil free bearings. Rotating freely allows for smooth transfer of the turning motion between the drive wheels 6 and 7, and the brush gear 16.

Each drive wheel 6 and 7 has a center gear 27 and 28. Each center gear 27 and 28 is capable of supplying the rotational motion to the brush wheel 3. Each center gear 27 and 28 is integrally manufactured into each bar 21 and 22 of each drive wheel.

Each center gear 27 and 28 has a diameter that is approximately twice the diameter of the brush wheel gear 16. The ratio of diameters between the gears assures that the drives wheels 6 and 7 will spin at the same speed. The ratio of diameters further assures that the brush gear 16 will spin at twice the speed of the drive wheels 6 and 7. The increased speed of the brush wheel 3 enables powerful cleaning of floor surfaces.

Each drive wheel 6 and 7 has an end gear or wheel 29 and 30 on the proximal end of the wheel 23 and 24, and an end gear or wheel 31 and 32 on the distal end of the wheel 25 and 26. Each proximal end gear or wheel 29 and 30 and distal end gear or wheel 31 and 32 is capable of direct contact with the respective main wheel 4 and 5 for receiving energy to turn the wheels 6 and 7.

Each proximal end gear 29 and 30 is inline with the proximal main gear 4 and each distal end gear 31 and 32 is inline with the proximal main wheel 5. Please note, main wheels 4 and 5 are connected to each other via an axel (not shown) and end gears 29 and 30 are connected to end gears 31 and 32 via axels 102 and 103, respectively. The inline placement allows a maximum transfer of rotation power from each main gear 4 and 5 to the respective proximal end gears 29 and 30 or distal end gears 31 and 32 without introducing slippage or shear stress into the drive system 1.

Each proximal end gear 29 and 30 and each distal end gear 31 and 32 are located at a predetermined distance from the center of each relative main gear 4 and 5. The location of each end gear enables the placement and intermeshing of the drive gears 16. The location assures that the drive system 2 fits securely within the case. The location of each end gear defines the diameter of the distal end gears. The size of the end gears enables a rotation that is capable of being free from direct contact from either main gear 4 or 5. For example, each end gear has a diameter that is between thirty percent and fifty percent of the diameter of the gears on the drive wheels 27 and 28. Preferably, the diameter of either drive wheel 27 or 28, respectively.

The location of each end gear defines the diameter of the end gears and the main gear. The end gears have a diameter that is approximately one quarter of the diameter of the drive wheel. Accordingly, the drive wheel is capable of providing rapid motion of the brush wheel despite relatively slow speeds. The thickness of the end gears is defined by the diameter of the gears so that the end gears are capable of withstanding normal stresses.

In use, the front drive wheel 6 spins in the same direction as the brush wheel 3 regardless of the direction of motion of the sweeper 1. The rear drive wheel 7 spins in the reverse direction of the brush wheel 3 regardless of the direction of motion of the sweeper 1. This relationship enables the brush wheel 3 to spin in the clockwise direction regardless of the direction of the sweeper 1.

The drive system 2 has an intermediate gear 34. The intermediate gear 34 directly contacts the brush gear 16 and the center gear 27 for the proximal drive wheel. The intermediate gear 34 has approximately the same diameter as the brush gear 16 to spin at the same rate as the brush gear 16. The intermediate gear 34 is capable of communicating the rotational power from the front drive wheel 6 to the brush wheel 3 so that the brush wheel 3 always spins in the clockwise direction.

The drive system has proximal and distal retainers 37 and 38. The retainers 37 and 38 keep the respective main gears 4 and 5 connected to the case. The retainers 37 and 38 are fabricated from a rigid plastic that is strong enough to handle the applied shear stresses.

The retainers 37, and 38 are each connected at the respective side wall of the case. The bottom section of each retainer 37 and 38 is connected to the respective main wheel 4 and 5. The retainers 37 and 38 enable the drive wheels to rotate about their center axis. The retainers also rotate freely about the connection to the case. Accordingly, the drive wheels are capable of connecting with either end gear simultaneously while the case is being pushed or pulled. This simultaneous rotation allows the main gear to drive the end gears and power the drive system.

The fact that the brush driving system is done through a gear train prevents slippage and consequentially maintains the ratio between the brushes.

In use, when the sweeper is moved forwardly, each main wheel 4 and 5 and retainer spins forwardly. The main gears 29–30 simultaneously grip the respective main wheel 4 and 5 and the respective end gear on the forward drive wheel 6. The connection causes the forward wheel 6 to spin forward, which then causes the reverse spin of the intermediate gear 34 and the forward spin of the brush wheel 3.

On the other hand, when the sweeper 1 is moved rearward, main gears and retainers simultaneously rotate about the respective axis. This simultaneous rotation translates the main wheels rearward towards the rear end gears. The connection between the main wheels and the end gears drives the rear drive wheel 7. The rotation of the rearward dive wheel is counterclockwise, so that the forward drive wheel spins clockwise, the intermediate gear spins counterclockwise, and the brush wheel spins clockwise.

On yet another hand, when the sweeper is being spun about the center, the main gears spin in opposing directions. In this configuration, opposing end gears will connect with either main gear. The opposing end gears will spin in opposing directions, resulting in the clockwise spin of the forward drive wheel. This spin drives the brush clockwise. The independent movement of the drive wheels ensures that even when the sweeper is being spun in a circular motion, one wheel will not break the free movement of the other, consequentially ensuring the maximum performance, ie brush speed and rotation per distance of movement. The performance is maintained even with the movement of one brush.

Figure 5:
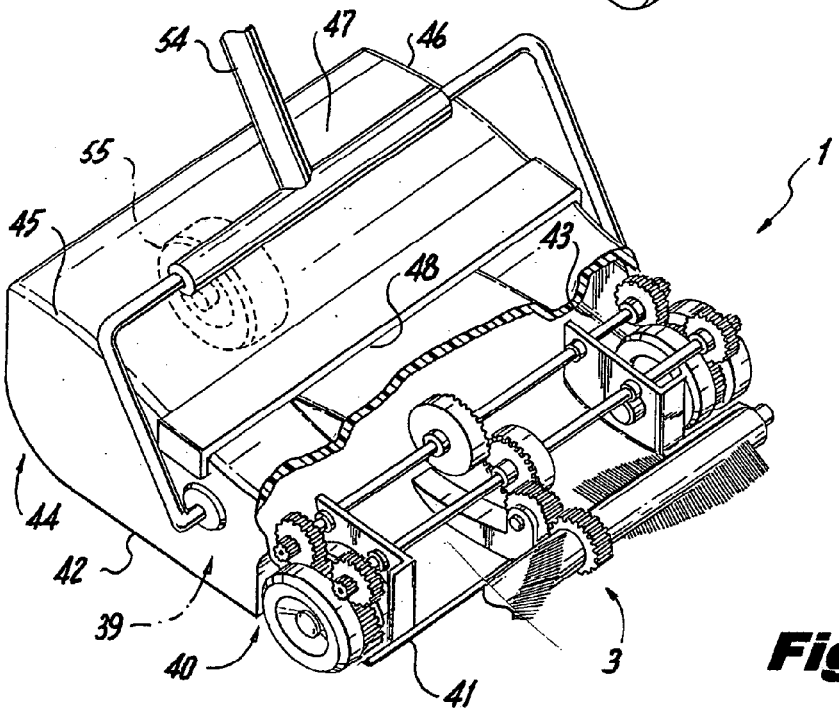
Figure 6:
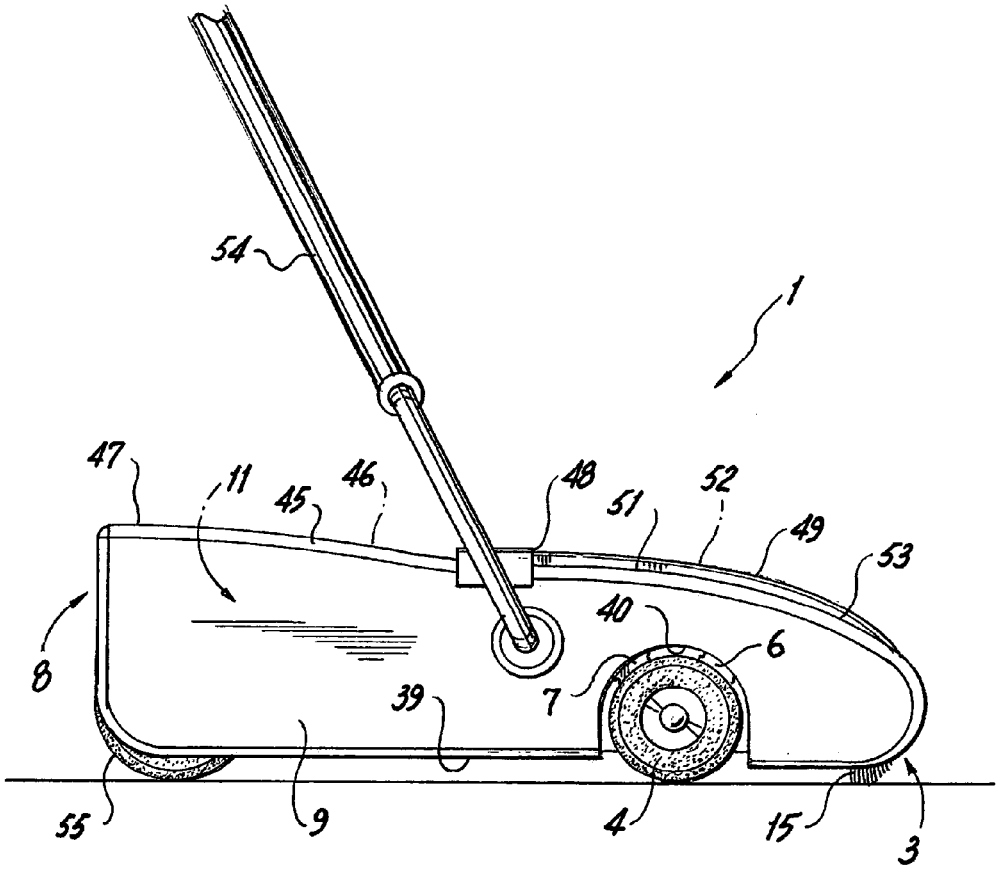
FIG. 6 is a side view of the sweeper.

Turning to FIGS. 5 and 6, the case 8 for housing the drive system 2 is disclosed. The case 8 is fabricated from a material that allows for repeated use in the home environment. For example, the case 8 is fabricated from a rigid plastic. The case 8 is large enough to house the internal components, such as the brush wheels 3, the drive wheels 6 and 7, and the main wheels 4 and 5.

The case 8 has a bottom 39 face. The bottom face 39 covers the bottom surface area of the sweeper 1. A plurality of openings 40 are integrated into the bottom face 39 for allowing the main wheels 4 and 5 to extend from within the case 8.

The bottom face 40 has a front edge 41 that extends along the front perimeter of the case 8. The front edge 41 of the bottom face 40 is located behind the brush wheel 3. The location of front edge 41 creates a front opening that allows the brush wheel 3 to operate without being hindered by the case structure 8. The front opening in conjunction with the construction conditions of the brush provides for picking of large debris sized up to the limit of half the brush diameter.

The bottom face 40 has proximal and distal side edges 42 and 43 extending along the side perimeter of the case 8. The side edges 42 and 43 are generally parallel to each other and perpendicular to the front edge 41. The length of the side edges 42 and 43 allows for the placement of the drive system 2 and brush wheel 3 within the case 8.

The bottom face 41 has a rear edge 44 extending along the rear perimeter of the case 8. The rear edge 44 has a shape that when viewed from above forms a semi-circle. The shape of the rear edge 44 maximizes the volume for storing dirt within the case 8. When dirt is drawn rearward into the case 8, a circular rear edge 44 prevents dirt from becoming wedged into corners found in typical sweepers.

Referring to the proximal and distal side surfaces 9 and 10, each surface has a respective front edge 45 and 46. The front edge is located behind the brush wheel 3 so that the brush wheel is not hindered during operation. The front edges 45 and 46 are long enough to allow the case 8 to conceal the drive system 2.

The side surfaces 9 and 10 extend rearward, along the edges 42 and 43 of the bottom face of the case 41. The side surfaces 9 and 10 curve rearward along the back of the case and are integrally joined in the back of the case 8. The cross sectional view of the rear of the surfaces 9 and 10, when viewed from above, is semi-circular. The semi-circular shape assists in preventing dirt from becoming logged in corners of the sweeper.

The side surfaces 9 and 10, when viewed from above, extend generally perpendicularly to the bottom face 41. The perpendicular extension is required for the mounting of the drive system 2. Along the rear edge of the case 44, the side surfaces 9 and 10 extend outwardly from the bottom to the top of the case 8. The outward extension increases the capacity of dirt storage for the case 8.

The case has a first top face 47. The first top face 47 extends over the top edge of the side surfaces 9 and 10, over the rear of the side surfaces 9 and 10. The top surface 47 has a front edge 48 located immediately behind the drive system 2. The top surface 47 is integral with the side surfaces 9 and 10. The top surface 47 forms the lid of the dust container 11.

The case has a second top face 49. The second top face 49 has a rear edge 50 that sits adjacent to the front edge 48 of the first top surface 47, between side surfaces 9 and 10. The edge 50 creates a dust tight connection between the second and the first top surface to prevent the venting of dust from the sweeper 1.

The second surface 49 has a pair of side edges 51 and 52 that sit on the top edges of the respective side surfaces 9 and 10. The connection between the side edges 51 and 52 and surfaces 9 and 10, are also dust tight to prevent the ventilation of dust from the sweeper.

The second surface 49 has a front edge 53 that extends over the drive system 2 to substantially cover the top portion of the brush wheel 3. The geometry of the second top surface 49 prevents dirt and dust from projecting out of the case 5 while the sweeper is in motion.

The top surface 49 is capable of being removed for cleaning the brush wheel 3 and drive system 2. The dust and particles stored within the case 8 are capable of being removed from the opening formed by the front edges of sides 9 and 10, top 47 and bottom 41.

The sweeper has a handle 54. The handle 54 is connected to the case 8. It should be clear that the handle is not necessary for the operation of the drive system 2 of he sweeper, and the sweeper is capable of being operated without a handle.

The sweeper has a rear support wheel 55. The rear wheel is capable of preventing the rear of the sweeper from dragging on the floor. A single rear wheel is used because a single wheel provides an ease of manipulation of the sweeper 1 when turning or reversing the direction of the sweeper 1.

The configuration of the sweeper within the case allows the sweeper brush to reach the limit of space between the floor and vertical obstacles such as a wall, furniture, etc. The capacity to mechanically generate brush rotation with the simple action of pulling the sweeper backwards ensures that the product performs in small spaces.

Accordingly, sweeper 1 has been disclosed having a drive system 2 that causes a brush wheel 3 to rotate in a single direction regardless of the motion of the sweeper where the drive system comprises wheels that capable of continuous and non-slip spinning.

The present invention may be embodied in other specific forms without departing from its spirit or essential characteristics. The described embodiments are to be considered in all respects only as illustrative and not as restrictive. The scope of the invention is, therefore, indicated by the appended claims and their combination in whole or in part rather than by the foregoing description. All changes that come within the meaning and range of equivalency of the claims are to be embraced within their scope.

I claim:

1. A sweeper comprising:

a first main wheel being capable of spinning in both a counterclockwise and a clockwise direction;

a brush wheel driven by said main wheel and being capable of spinning in a counterclockwise direction irrespective of the spinning direction of the main wheel;

a plurality of intermediate wheels capable of translating the spinning motion from said main wheel to said brush wheel via an outer circumference of the main wheel; and each of said wheels capable of simultaneous and non-slip spinning, wherein said plurality of intermediate wheels comprising a first drive wheel, a second drive wheel and a third gear wheel, said first drive wheel including a first gear wheel and the second drive including a second gear wheel;

said first drive wheel capable of spinning in a clockwise direction, said second drive wheel capable of spinning in a counterclockwise direction, said third gear wheel being in direct contact with the first gear wheel and the brush wheel;

said first drive wheel having a first end wheel and said second drive wheel having a second end wheel, said first end wheel capable of connecting with the outer circumference of the main wheel when said main wheel spins in a clockwise direction and said second end wheel capable of connecting with the outer circumference of said main wheel when said main wheel spins in a counterclockwise direction.

2. The sweeper of claim 1 having a case and a handle, the handle connected to the case and capable of being removed from the case.

3. The sweeper of claim 2 having a second main wheel, said first and second main wheels capable of fitting within said case.

4. The sweeper of claim 3 wherein said brush wheel having a gear capable of rotating said brush wheel simultaneously with said third gear wheel.

5. The sweeper of claim 4 wherein the first and second main wheels are at least twice the diameter of the first and second drive wheels.

6. The sweeper of claim 5 wherein the first gear wheel is the same diameter as the second gear wheel, and the first and second gear wheels are larger in diameter than the first and second end wheels and smaller in diameter than said first and second main wheels.

7. The sweeper of claim 6 wherein the brush wheel is smaller in diameter than said first and second gear wheels and larger in diameter than said first and second end wheels.

8. The sweeper of claim 7 wherein the third gear wheel is substantially the same diameter as the brush wheel.

9. A sweeper comprising:

a brush wheel, first and second drive wheels, first and second end gears, and first and second main wheels, whereby said brush wheel, said first and second drive wheels, said first and second end gears, and said first and second main wheels are in rotational communication with each other;

wherein the outer circumference of each main wheel is capable of automatically shifting to the first or second drive wheel independently of one another in response to sweeper movement, thereby causing the brush wheel to spin in a single direction regardless of the direction of the sweeper; and wherein the drive wheels are capable of simultaneous and non-slip spinning.

10. The sweeper of claim 9 comprising a retainer for holding each main wheel to said sweeper; where each wheel comprises gears and each gear capable of continuous non-slip spinning.

11. The sweeper of claim 10 having a container, the container having a dust pan, the dust pan having a semicircular shape.

12. The sweeper of claim 11 having a rear wheel capable of supporting the rear of the case.

13. The sweeper of claim 12 having a handle.

14. The sweeper of claim 13 where said brush wheel will spin in a single direction when the sweeper is rotated on a vertical axis.

* * * * *